US007353549B2

(12) United States Patent
Muir, Jr.

(10) Patent No.: US 7,353,549 B2
(45) Date of Patent: Apr. 8, 2008

(54) TOILET SEAT WITH INTERGRATED TARGETING AND MEASUREMENT SYSTEM

(75) Inventor: David Neal Muir, Jr., 12229 Fairfield House Dr. #203, Fairfax, VA (US) 22033

(73) Assignee: David Neal Muir, Jr., Fairfax, VA (US)

( * ) Notice: Subject to any disclaimer, the term of this patent is extended or adjusted under 35 U.S.C. 154(b) by 166 days.

(21) Appl. No.: 11/308,362

(22) Filed: Mar. 19, 2006

(65) Prior Publication Data

US 2007/0214564 A1 Sep. 20, 2007

(51) Int. Cl.
*A47K 17/00* (2006.01)

(52) U.S. Cl. ..... 4/661

(58) Field of Classification Search ..... 4/300.3, 4/661

See application file for complete search history.

(56) References Cited

U.S. PATENT DOCUMENTS

| | | | | |
|---|---|---|---|---|
| 5,720,254 | A * | 2/1998 | Yoshida et al. | 123/305 |
| 6,385,796 | B1 * | 5/2002 | Muir, Jr. | 4/661 |
| 6,513,713 | B1 * | 2/2003 | Aruga | 235/449 |
| 6,572,564 | B2 * | 6/2003 | Ito et al. | 600/573 |
| 6,772,454 | B1 * | 8/2004 | Barry et al. | 4/661 |
| 6,779,206 | B1 * | 8/2004 | Sykes | 4/661 |
| 7,194,776 | B1 * | 3/2007 | Lastuka et al. | 4/661 |
| 2005/0288105 | A1 * | 12/2005 | Piccionelli et al. | 463/49 |

* cited by examiner

*Primary Examiner*—Charles E. Phillips

(57) ABSTRACT

An interactive toilet seat provides a target for a urine stream from a user. A user will direct their stream of urine at a target which is suspended in the bowl of a toilet. This target is in communication with a control circuit which is in turn communicating with an electronic display. The display is set to display various indicators, entreaties, goads or comparisons which enhances the use of the system.

12 Claims, 4 Drawing Sheets

TOILET SEAT WITH INTERGRATED TARGETING AND MEASUREMENT SYSTEM

BACKGROUND

Many men have an urge to prove that they can hit a target and are taught from potty training to aim their stream of urine. If there is something in the toilet, the urine stream is frequently directed at that something, be it a mark on the bowl or something floating. This device provides a target for a user to actually quantify his accuracy and gain enjoyment from an everyday necessity.

The disclosure of U.S. Pat. No. 6,385,796 to David Muir, Jr. is incorporated by reference with all the disclosure and teachings therein.

SUMMARY OF THE INVENTION

A toilet lid and target below the lid is disclosed. The lid has an electronic assembly that is battery powered with a display which is LCD in nature. Suspended below the lid within the confines of a toilet bowl is a target. This target is connected to the lid electronics and is so supported to sense the impact of a stream of urine. This sensory mission not only determines that impact is occurring, but how hard, thereby making possible a measure of the accuracy of a user but, also, enabling a measurement of quantity.

DESCRIPTION OF THE PREFERRED EMBODIMENTS

Figure 1:
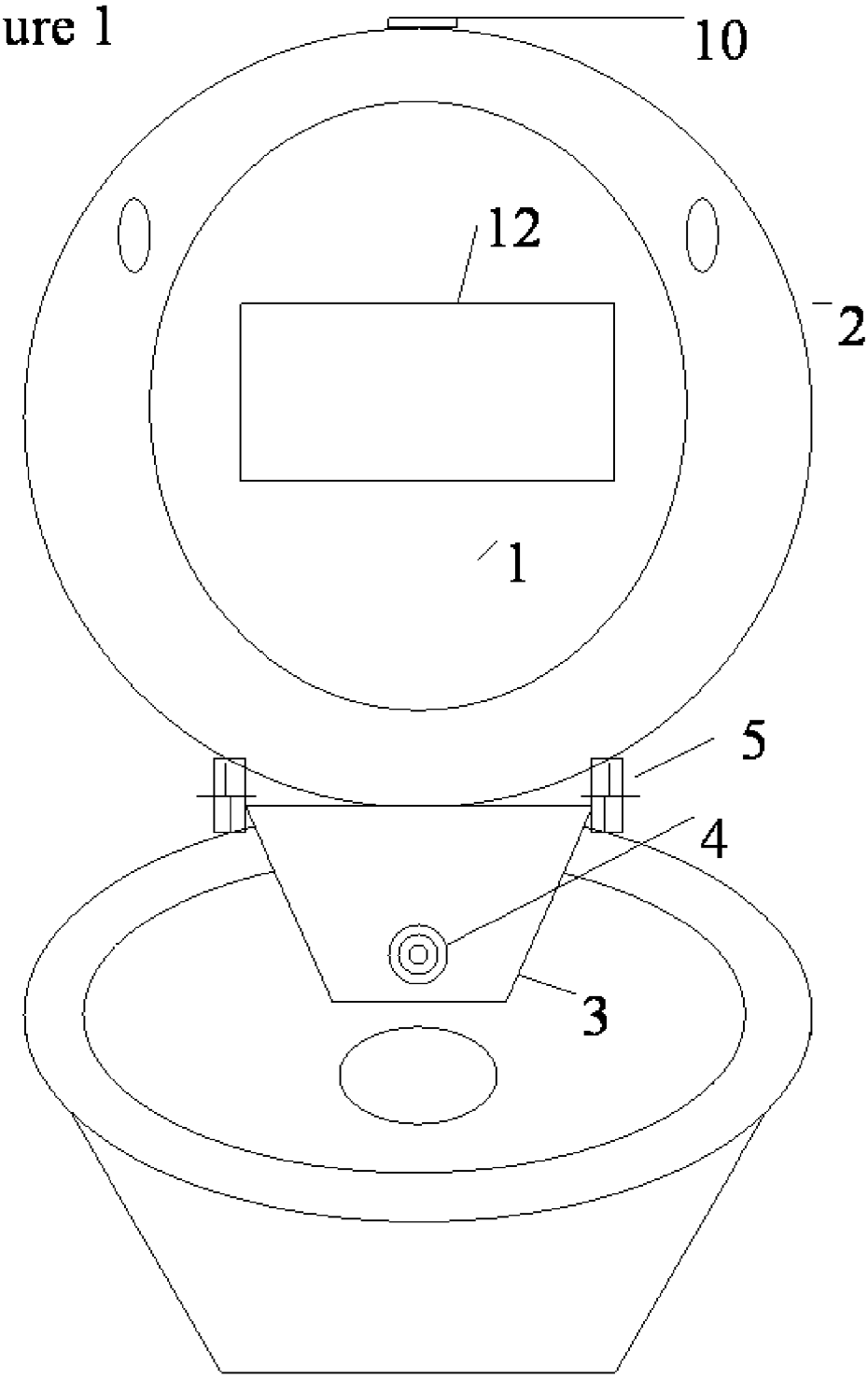
FIG. 1 is a front view of the lid assembly with the target support down in place in the bowl of the toilet with the seat raised.
Figure 2:
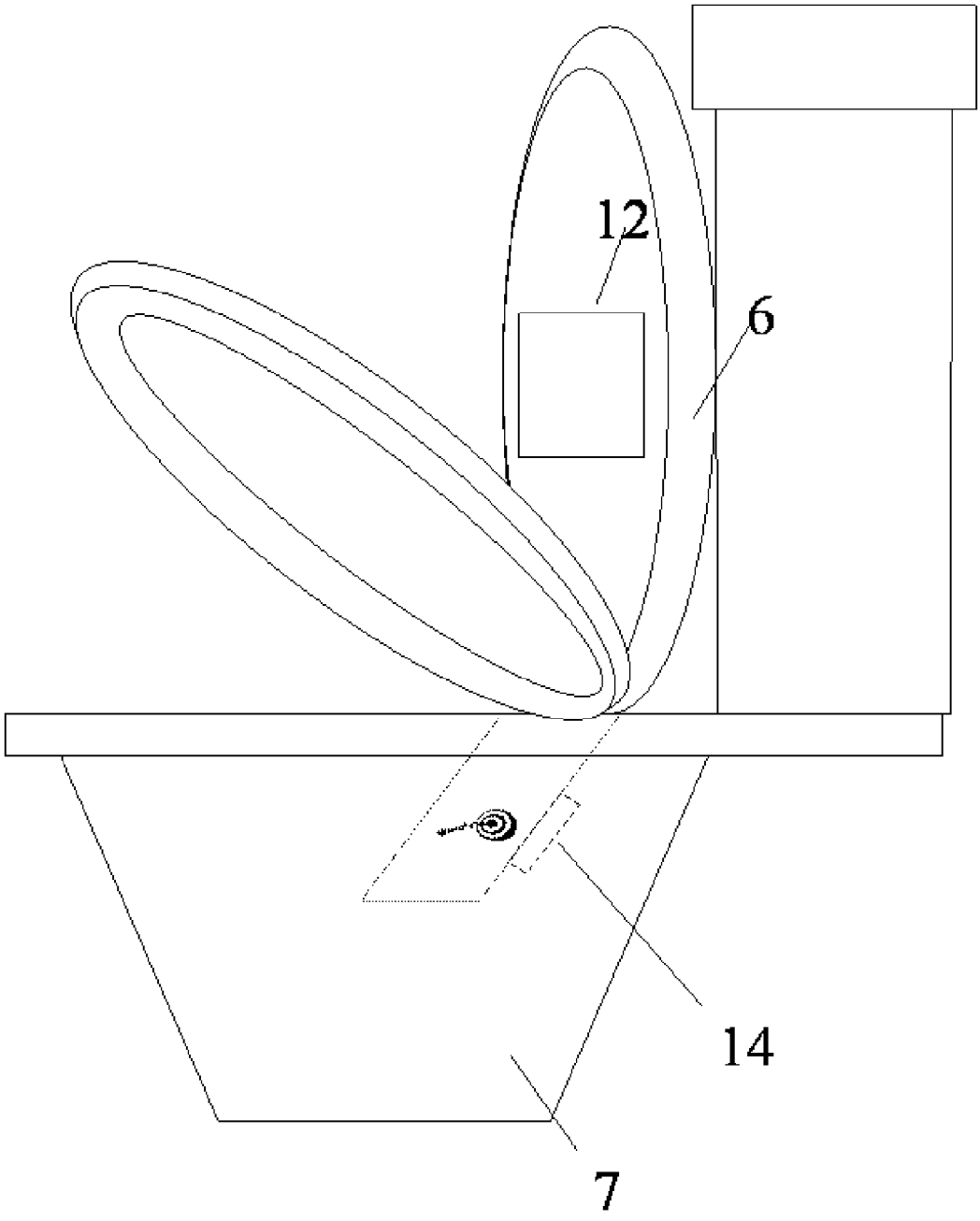
FIG. 2 is a side view of the lid assembly showing an orientation of the target within the bowl of the toilet.
Figure 3:
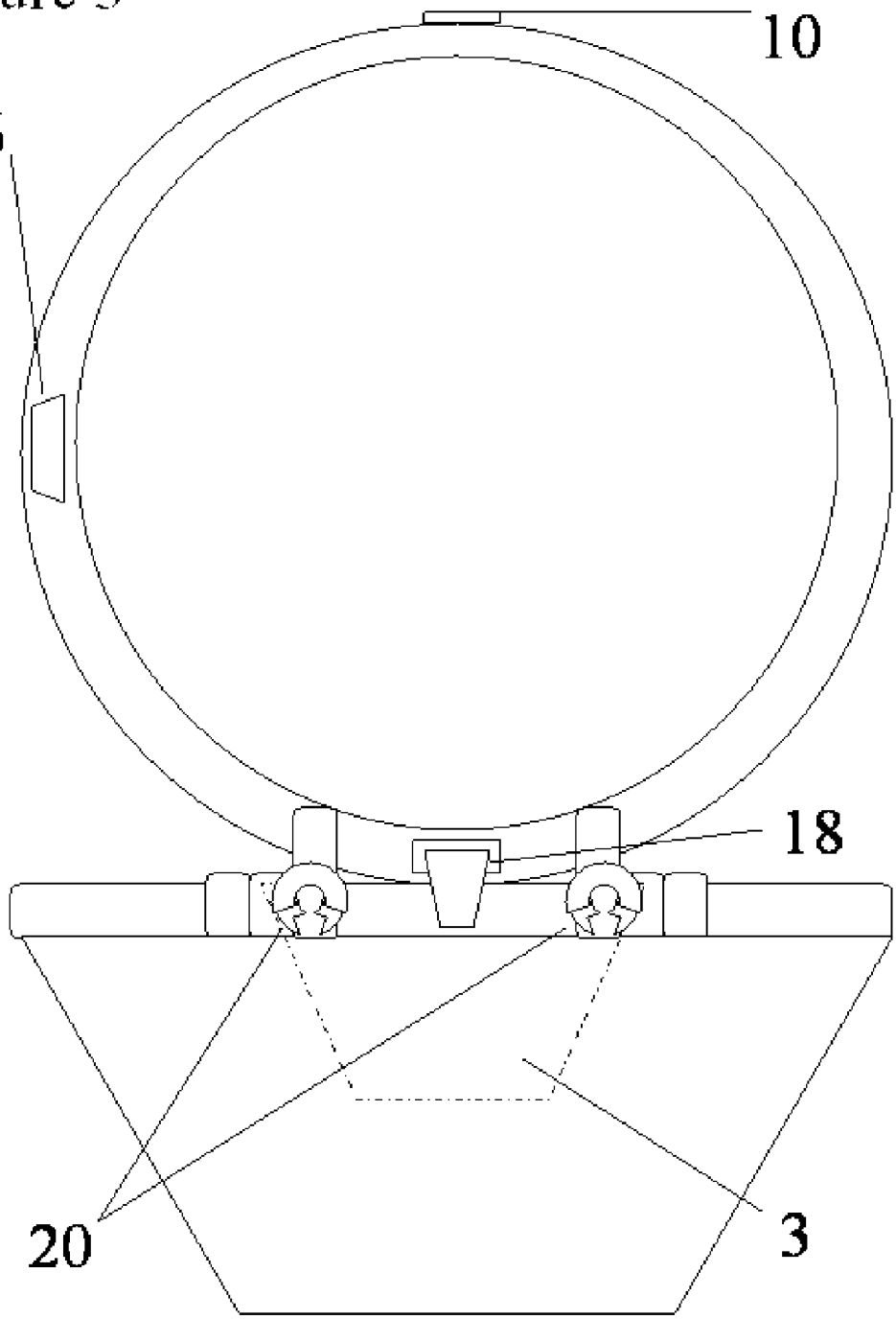
FIG. 3 is a rear view showing possible electronic connection and an alternate connection of the target to the bowl.

This target assembly is a part of a normally found lid and seat on most toilets. This target assembly is supported below lid 1 and seat 2 on a flange 3. The target 4 may be supported on a flange 3 which may be hinged as at 5 or may have a separate seducement as at 20, see FIG. 3.

The flange 3 is the primary support for a sensor 14 which in turn supports the target 4. The sensor 14 is electronically connected by conduit 32 to controller 24, see FIG. 5. Currently a spring loaded sensor is used for sensor 14 which not only deflects the target 4 upon impact but will deflect varied amounts according to the directness of the impact. Measuring the amount of deflection allows the controller to estimate the amount of the stream as well as accuracy. Another mechanism, not shown, such as a flowmeter, is also contemplated and would be readily apparent to one of ordinary skill in the art.

One convenient location of the system initiator is at the forward portion of the lid 1. The initiator 10 is electronically connected by conduit 31 to controller 24. The initiator 10 is presently a spring loaded button, as shown by spring 28, with contacts as is normally used in the electronic industries. It is envisioned that other locations and types of initiator may be used concurrent with the scope of the invention and claims, such as motion or heat sensors. These and other sensors or initiators are well within those capabilities of one of ordinary skill in the electronic arts and seen to be comprehended by the claims, hereafter.

Figure 4:
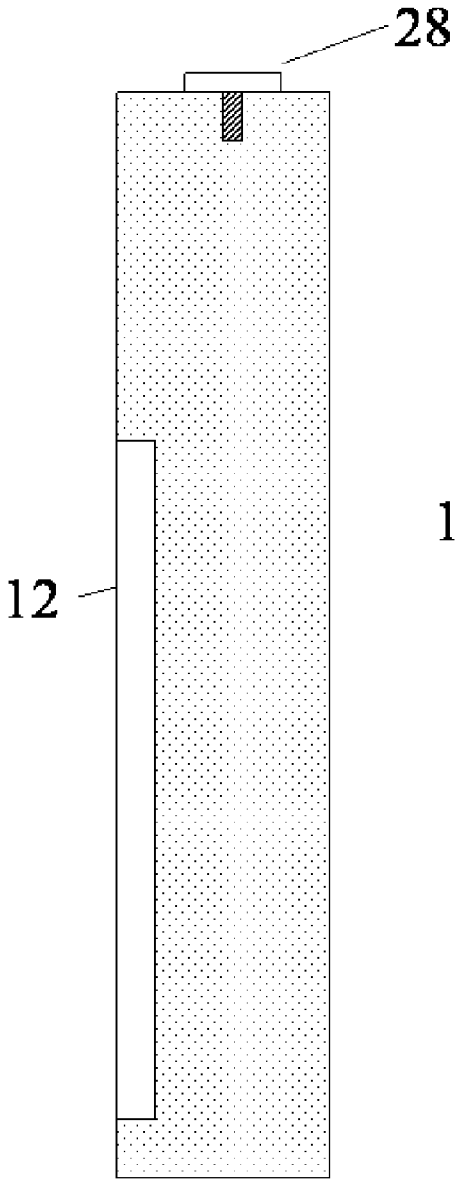
FIG. 4 is a partial view showing one orientation of an initiator and display.

A display screen is shown at 12. Currently this is seen to be an LCD type of display. The display may be embedded into the lid as shown in FIG. 4, or may be attached to a normal lid using any known securing devices such as screws or glue. The display 12 may be divided into a variety of sections, each section with its own display of data, or may be one display of chosen data, such as an accumulating total of estimated fluid impacting. Other uses for the display 12 may be for goads or razes upon a minimal or unsuccessful encounter, or congratulations for a successful usage. It is anticipated that a user will have access to controller 24 to establish the type messages displayed, either physically or electronically such as through communications port 18. Other uses are anticipated in conjunction with Internet or electronic communication with other such similar assemblies as available using port 18, see FIG. 3, which is in turn connected to the controller 24.

Figure 5:
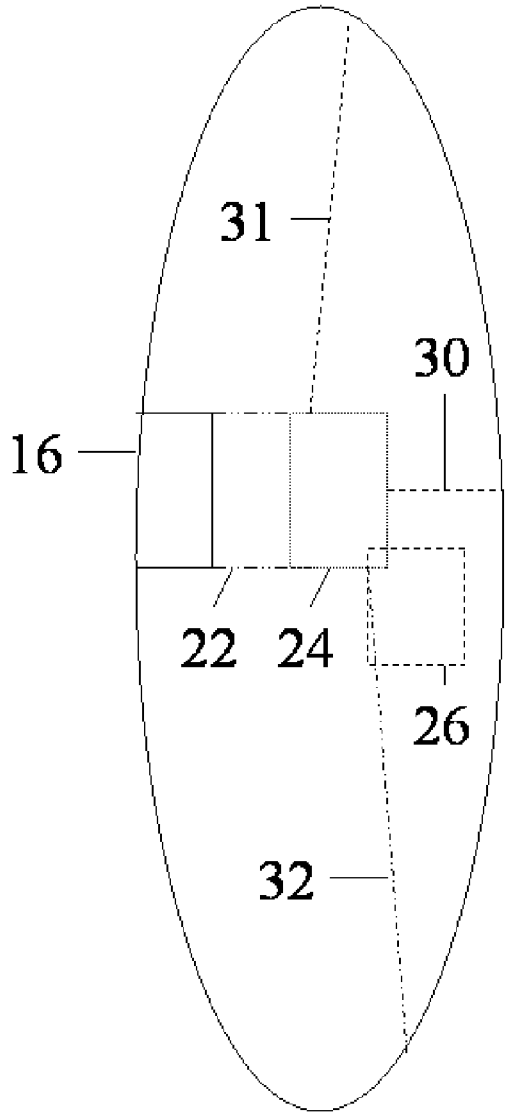
FIG. 5 is a partial view of the lid with battery compartment and control assembly in phantom.

As seen in FIG. 5, battery compartment lid 16 covers battery compartment 22. This battery compartment 22 is directly attached or integral with controller 24. It is envisioned that battery compartment 22 with controller 24 may be removed to enable a user to make changes to the display. The electronics of the controller may be varied in that it may be digital or otherwise. It may be programmable or it may have a single program for control of the display in response to duration and amount of deflection of the target 4 as sensed by sensor 14. The conduits or wires 31 to the initiator and 30 to the display and 32 to the sensor may be hard wired to the controller 24 or may be attached to contacts which make contact with controller 24 upon insertion.

It is considered that controller 24 is a microprocessor of many varied types now available in the electronic industry that may respond to varied internal programs.

Controller 24 also makes contact with a sound transducer 26. This may be a speaker that makes contact with the controller or may be mounted distal from the controller but connected thereto by electrical conduit.

What is claimed is:

1. A target assembly comprising; a hinged support mounted under a toilet seat such that said support can be moved from a position inside a toilet bowl to a position outside of a toilet bowl to enable cleaning thereof, a sensor mounted on said support, a target mounted on said sensor, said sensor being capable of measuring time duration of an impinging urine stream as well as intensity of the stream on said target, such that the amount of urine flow of said stream may be estimated, said sensor being in electronic communication with a controller, said controller being in electronic communication with a visual display screen, said display screen being mounted on the underside of a toilet lid, such that display images of the results estimated by said sensor and controller may be viewed by a user during use of said assembly.

2. The target of claim 1 where said controller is battery powered.

3. The target of claim 1 where said controller is in communication with an initiator.

4. The target of claim 1 where said controller is removable for alteration.

5. The target of claim 1 where said controller is a microprocessor.

6. The target of claim 1 where said controller is connected to a sound transducer.

7. The target of claim 1 where said visual display is an LCD display.

8. The target of claim 5 where said microprocessor will retain results from previous uses for comparison and display.

9. The target of claim 5 where said microprocessor measures time of use for incorporation into the display with a specific displayed message.

10. The target of claim 1 where said toilet seat and lid are composed of one of metal, fiberglass, plastic and/or wood.

11. The target of claim 1 with an actuator on said toilet lid placed for manual actuation by a user, said actuator in electrical communication with said controller.

12. The target of claim 11 where said actuator is spring loaded.

* * * * *